United States Patent [19]

Ophey

[11] 4,375,330

[45] Mar. 1, 1983

[54] CONTROL CIRCUIT IN AN ELECTROPHOTOGRAPHIC COPYING MACHINE

[75] Inventor: Petrus J. M. Ophey, Grubbenvorst, Netherlands

[73] Assignee: Oce-Nederland B.V., Venlo, Netherlands

[21] Appl. No.: 215,147

[22] Filed: Dec. 11, 1980

[30] Foreign Application Priority Data

Dec. 18, 1979 [NL] Netherlands ..... 7909098

[51] Int. Cl.[3] ..... G03G 15/00

[52] U.S. Cl. ..... 355/14 R

[58] Field of Search ..... 355/14 R, 14 CU, 16, 355/3 R, 14 E, 14 D, 3 BE

[56] References Cited

U.S. PATENT DOCUMENTS

| | | | |
|---|---|---|---|
| 3,575,505 | 4/1971 | Paramigiani | 355/14 D |
| 3,600,086 | 8/1971 | Cates et al. | 355/16 |
| 3,914,047 | 10/1975 | Hunt | 355/16 |
| 4,110,033 | 8/1978 | Ophey | 355/14 R |

FOREIGN PATENT DOCUMENTS 1555341 11/1979 United Kingdom .

*Primary Examiner*—Richard L. Moses
*Attorney, Agent, or Firm*—Albert C. Johnston

[57] ABSTRACT

In a copying machine comprising a photoconductive belt (5) that is moved past a number of processing stations in order to make copies, the belt (5) is divided relative to a reference point into a plurality of imaging sections each of which is capable of copy formation. Each imaging section is subject to deterioration as a function of the number of times a copy has been made with the use of that imaging section. A control circuit (100, 110) is provided comprising a counter memory (102) that for each imaging section stores the number of copies made with the use of that imaging section. The control circuit (100, 110) further comprises means (103, 105, 106, 107) which, as a function of the count in the memory (102) for a particular imaging section, adjust one or more of the processing stations when a processing station is acting on that imaging section. The control circuit (110) further comprises means (116, 120, 121, 122, 123) to prevent copy formation on a particular imaging section when that imaging section is no longer suitable for copy formation either because having been used a maximum number of times in copy formation or because of having been damaged.

6 Claims, 9 Drawing Figures

CONTROL CIRCUIT IN AN ELECTROPHOTOGRAPHIC COPYING MACHINE

This invention relates to a control circuit in an electrophotographic copying machine provided with a photoconductive element to be fed past processing stations in order to make copies, with electrophotographic properties of the element changing in a predictable manner as a function of the number of copies formed by its use, by which control circuit one or more of the processing stations is adjusted to compensate for changes in properties of the photoconductive element.

It has long been known, as disclosed for instance in Dutch Patent Application No. 72.17484 (published June 25, 1974), that the light sensitivity of an endless photoconductive belt element used in an indirect electrophotographic copying machine decreases with repeated use of the element for making copies and that the changes which occur can be compensated by regulating the intensity of the illumination used for exposure of the element during its continued use in the copying machine.

In the various processing stations of an electrophotographic copying machine, such as the charging, exposure, developing, and transfer stations, the photoconductive element is subjected repeatedly to chemical and mechanical influences which have a progressively detrimental and irreversible effect on the usability of the photoconductive element for forming copies. This effect can be observed, for example, in a slowly reducing sensitivity of the element to light, or in reduced charge holding capability as insulation properties of the element are reduced. The purpose of a special control system of the type mentioned is to compensate for the consequences of such detrimental and irreversible effects.

An electrophotograhic copying machine employing an endless photoconductive belt element and provided with a special control circuit designed to compensate for decreases in the light sensitivity of the element is disclosed in U.S. Pat. No. 3,914,047 and corresponding foreign patents, and also in British patent specification No. 1,555,341. The special control circuit comprises a counter which registers the total number of times a copy is made with the aid of the photoconductive element and, depending upon the count of the counter, the action at one of the processing stations, such as the intensity of illumination at the exposure station, is adjusted to compensate for the detrimental and irreversible effects on the photoconductive element so that their consequences in the operation of the processing stations as a whole will not be reflected in the copies made. Since the count used for the adjustment in that system is based on the number of copies made, accurate compensation for changed properties of the photoconductive element cannot be obtained unless the total number of counted copies is assumed to be distributed uniformly over the entire surface of the photoconductive element.

Such a control system is disadvantageous in that it does not take account of the fact that during normal use of the copying machine conditions can arise systematically in which some portions of the photoconductive element are employed more frequently than other portions for the formation of copies. Conditions of this kind exist, for example, when the length of the path to be traversed by the photoconductive element past the processing stations during the formation of a copy is greater than the length of a copy to be made. In such cases, during the information of a single copy a considerable portion of the length of the photoconductive element is passed through the copying machine but is not used for making a copy. Depending upon the length of the said path to be traversed, the unused portion of the photoconductive element will have a length on which one or several copies could be made. A like condition also exists in all cases after making the last copy of a series of copies from one and the same original.

It results that in the course of use of the photoconductive element its electrophotographic properties will differ from place to place, so that copies are obtained which are not always of optimum quality even if the known control circuit is employed.

It is to be noted that German Offenlegungsschrift 24 46 919 discloses an apparatus in which a photoconductive element is divided into a number of imaging sections with respect to a reference point and a circuit is provided for registering the position of the element with respect to one or more of the processing stations.

The principal object of the present invention is to provide a control circuit in an electrophotographic copying machine which will accurately compensate for changed properties of the photoconductive element so that the disadvantage noted above can be avoided.

In accordance with this invention, such a control circuit is provided which comprises counter means having a counting element for each of a plurality of imaging sections into which the photoconductive element is divided with respect to a reference point, each of which sections can be used for copy formation, so that each counting element will count the number of copies made with use of the corresponding imaging section; further, a circuit is provided for registering the position of the photoconductive element with respect to one or more of the processing stations; and adjusting devices are connected with the counter means and the registering circuit and are made operative by a count of the counting element corresponding to any imaging section to adjust one or more of the processing stations while the same are acting on that imaging section.

With this control system, the number of times a copy is made with the use of a certain imaging section plays no part in the adjustment of an adjustable processing station when that processing station is acting on another imaging section. Each time a copy is made with the use of a certain imaging section, each adjustable processing station is adjusted to an optimum value for that particular imaging section. Consequently, all copies made with a copying machine provided with a control circuit in accordance with the invention will be of extraordinarily constant quality.

The above mentioned and other objects, features and advantages of the invention will be further evident from the following detailed description and the accompanying drawings of illustrative embodiments of the invention. In the drawings.

Figure 1:
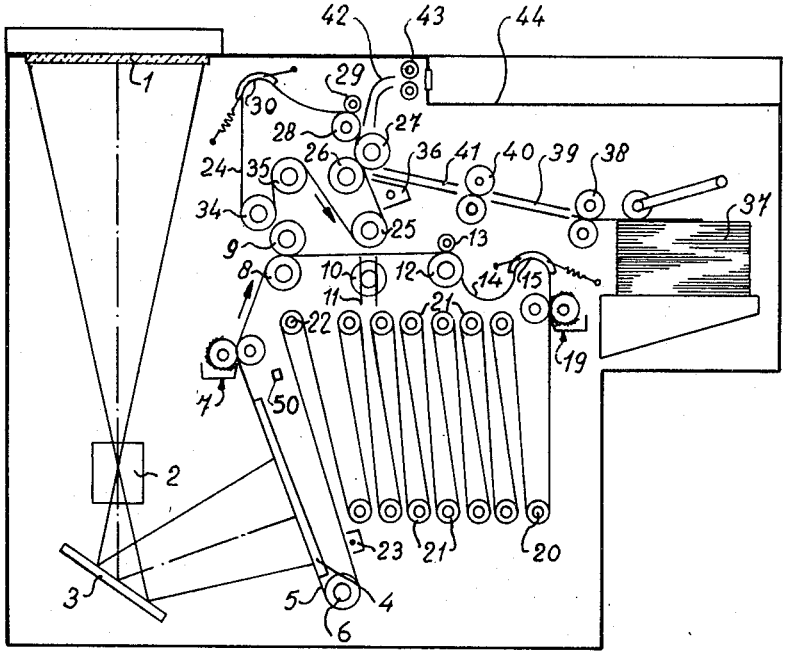
FIG. 1 is a schematic cross sectional view of an electrophotographic copying machine in which a control circuit in accordance with the invention can be employed.

In the copying machine shown schematically in FIG. 1 an endless belt 5 composed of a photoconductive layer on an electrically conductive layer, after being uniformly charged by a corona device 23, is advanced over a roller 6 and over a suction chamber 4 at an exposure station where suction holds the continuously moving belt 5 flat against the chamber 4. An electrostatic charge image is then formed on the belt by an imagewise exposure of the belt surface to light which discharges the photoconductive layer in the light-struck areas. The imagewise exposure is effected by illuminating an original located on an exposure plate 1 by one or more flash lamps 108 (FIG. 5; not shown in FIG. 1) and projecting the image of the original onto the belt 5 via a lens 2 and a mirror 3. By virtue of the flash illumination the belt can move continuously while the original lies still.

The belt section on which the latent electrostatic charge image is formed, which is referred to herein as an imaging section, then is moved past a developing device 7 where developing powder is applied to it so that the latent image is converted into a powder image.

The belt is driven continuously by a drive roller 8, which can be engaged by a pressure roller 9, and which is provided with an outer surface having a high coefficient of friction with respect to the back side of the belt.

The belt passed from the drive roller 8 runs over a roller 10 which is movable toward and away from the belt along a guide 11, i.e. up and down as seen in FIG. 1. When roller 10 is down the belt runs free. When moved up against the belt, roller 10 presses the belt against the face of a transfer belt 24 being passed about a roller 25 so that the powder image on belt 5 will be picked up by the belt 24, as disclosed in U.S. Pat. No. 4,068,937. The belt 5 then moves over a driven roller 12, which can be engaged by a pressure roller 13, and then hangs down into a tensionless loop 14 extending to a stationary curved surface 15 which serves to guide the belt and keep it straight, as disclosed more fully in U.S. Pat. No. 3,846,021. The belt 5 then moves from surface 15 to a cleaning device 19, known per se, for removing residual powder, and then is guided around a roller 20 toward and over a multiplicity of reversing rollers 21 which together form a magazine for accumulating a large part of the length of the belt. From this magazine the belt is passed over roller 22 and then past the corona device 23 to roller 6 in readiness for another run through the image forming and transfer stations of the apparatus.

The roller 25 functions as a drive roller for the belt 24. This belt is passed between a pair of rollers 26 and 27, and then between rollers 28 and 29 toward a stationary curved surface 30 which serves to guide the belt 24 and keep it straight in the manner disclosed in said U.S. Pat. No. 3,846,021. A lead of the belt 24 hangs down freely between the rollers 28 and 29 and the surface 30. From surface 30 the belt 24 passes to a guide roller 34, thence over a roller 35, and from there back to the drive roller 25.

A radiant heating device 36 is arranged to direct heat toward the face of belt 24 in the belt lead between roller 25 and rollers 26 and 27. When a powder image has been transferred from the belt 5 to belt 24 at the location of the rollers 10 and 25, the radiant heating from device 36 makes the powder image on belt 24 sticky so that it can easily be transferred from belt 24 to a sheet of copy paper. The copy sheet is fed from a stack 37 via rollers 38, a guide 39, rollers 40 and a guide 41 to the nip between belt 24 and roller 27, and from this nip the copy sheet is fed through a guide 42 to rollers 43 which deposit the sheet into a copy tray 44.

During the formation of a copy in the manner described above the photoconductive belt 5 is exposed to a variety of detrimental chemical and mechanical loadings, such as those which attend the electrostatic charging of the belt 5 by the corona device 23, the development of the latent image at the developing station 7 and the feeding of the belt through the magazine defined by the rollers 20, 21 and 22. The effect of such detrimental influences can be compensated for almost completely during a considerable proportion of the service period of the belt 5.

Some examples of ways in which compensation can be provided are: by control of a voltage applied in the developing unit 7, or by control of the corona voltage in the corona device 23, or of the aperture of the lens 2, or of the power supply voltage for the flash lamps 108, or of the pressure at the nip between the rollers 10 and 25. Various other ways of compensation are also feasible.

As an illustrative but not limiting example, a description is given below of effecting the compensation by control of the light intensity of the illumination of the belt 5.

The background image areas on a copy of an original having a white background, such as text on a white sheet, generally are not to be developed by the developing device 7. For a certain imaging section of the belt 5, i.e., an area on which an electrostatic latent image is to be formed and developed, FIG. 2 graphically represents the relationship between the number of times n that a copy is made with the use of that certain imaging section and the intensity I of the illumination of the photoconductive layer that results in reduction of the electrostatic charge in the background image areas to a level below a threshold value that no longer can be developed.

Figure 2:
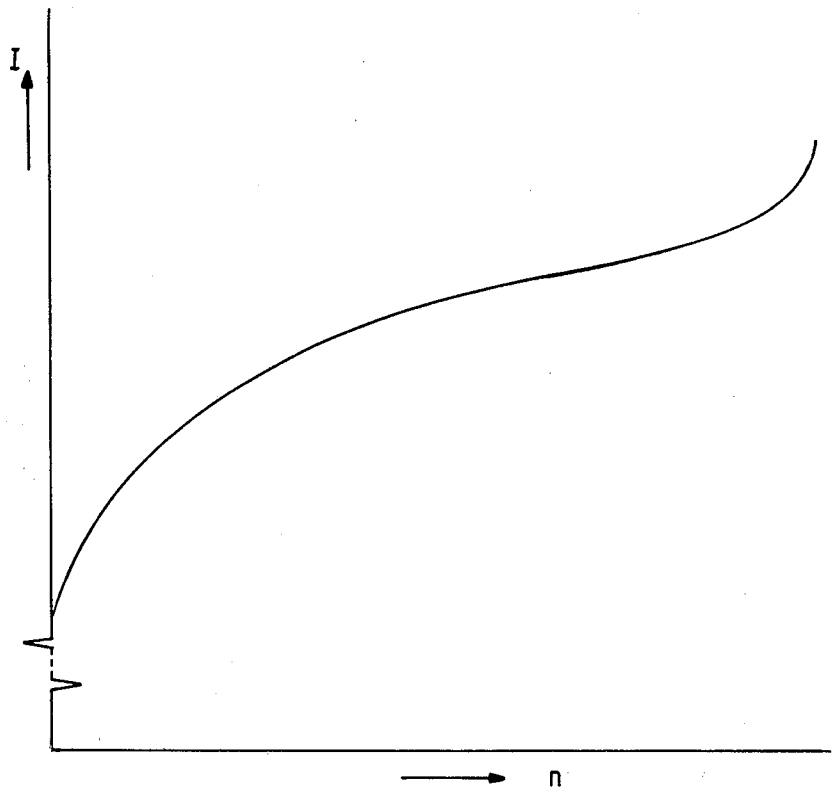
FIG. 2 is a graphic representation, for a certain imaging section of a photoconductive element, of the relationship between the light intensity required for exposure of the photoconductive layer and the number of times a copy is made with the use of this imaging section.

The shape of the curve shown in FIG. 2 is to some extent dependent on the type of photoconductive layer present on the belt, but fundamentally the curve can be determined for each type of photoconductive layer.

Matching of the illumination intensity to the properties of the photoconductive layer can be effected by controlling the supply voltage to the flash lamps 108 which illuminate the original, or by controlling the size of the aperture (not shown) of the lens 2. Because of it being simpler in execution, preference is given to the first possibility, and an embodiment employing it will now be described more particularly with reference to FIGS. 3, 4 and 5.

Figure 3:
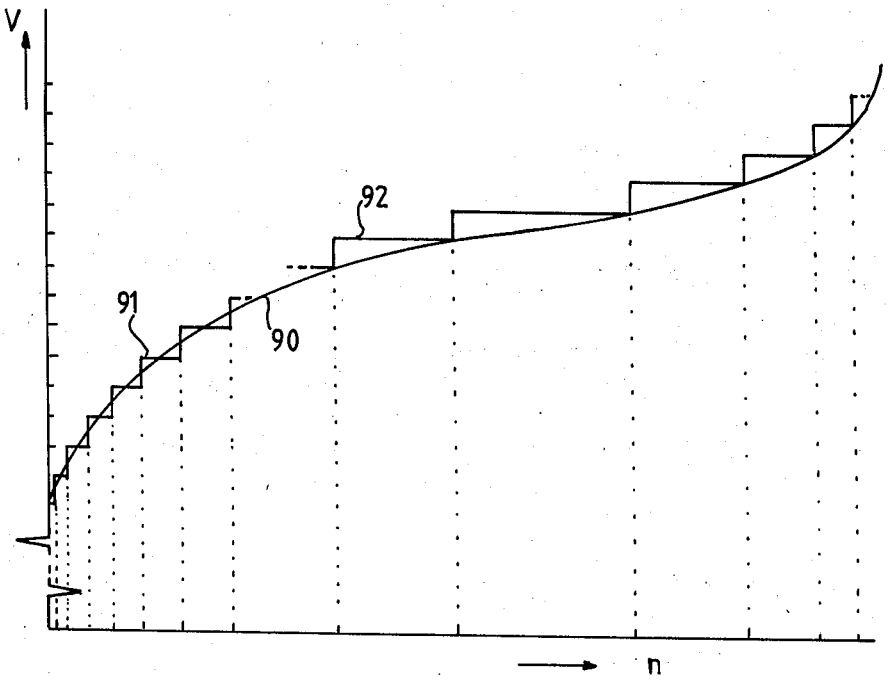
FIG. 3 is a graphic representation of variations of a lamp supply voltage as required in order to effectuate substantially the changes of light intensity indicated in FIG. 2.

FIG. 3 shows a curve 90 which corresponds with the curve shown in FIG. 2. As in FIG. 2, there is plotted along the abscissa the number of times n that a copy is made with the use of a certain imaging section. The magnitude of the supply voltage required for the flash lamps 108 in order to have an optimum illumination intensity for belt 5 is plotted along the ordinate.

The trend of the curve 90 can be complied with precisely if so required. In actual practice, however, and certainly with use of a photoconductive element having a long service life, such precision would needlessly involve extensive electronic circuitry. It is considered sufficient in actual practice to have an approximation in the form of a step-shaped curve, such as shown at 91 and 92, in which for a certain imaging section the same supply voltage is supplied to the flash lamps for a considerable number of consecutive image formations before the voltage is increased to compensate for a change of properties of the imaging section concerned. By increasing the number of stages in the step-shaped curve, the curve 90 can be approximated as closely as practically required.

Figure 4:
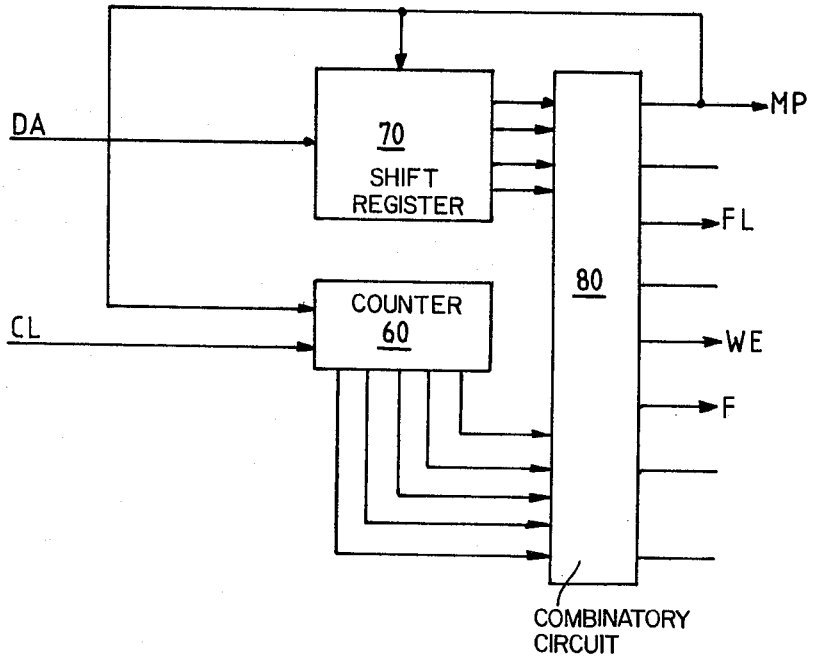
FIG. 4 is a schematic diagram of a main electrical control circuit for a copying machine in accordance with FIG. 1.
Figure 5:
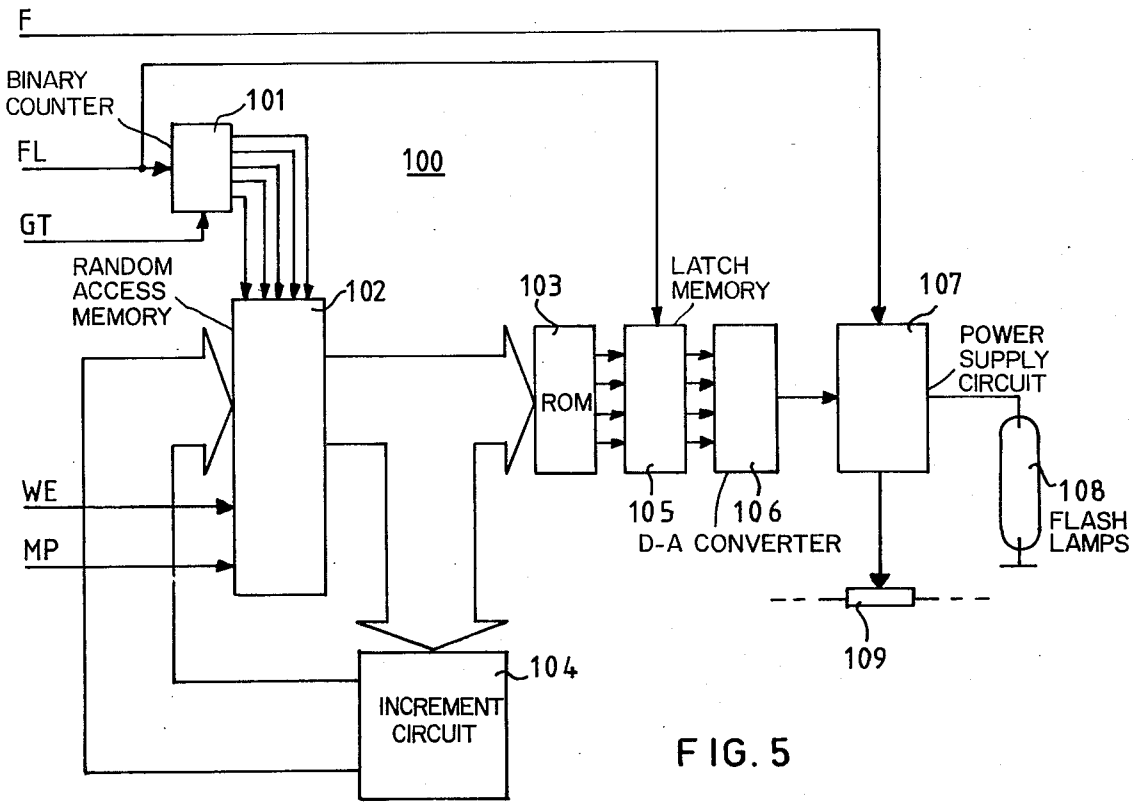
FIG. 5 is a schematic diagram of a control circuit in accordance with the invention.

Referring now to FIGS. 1, 4 and 5, the embodiment of the invention as shown schematically in them provides a control circuit by which adjustments of the illumination intensity in accordance with FIG. 2 can be approximated for each imaging section on the belt 5 independently of the adjustments for any other image section.

In the embodiment shown in FIG. 1 the photoconductive belt 5 usually is made endless by joining ends of a finite belt length by means of a seam. At the location of the seam the belt can be provided with a marking which is detectable whenever it moves past a detector 50, as a result of which the detector 50 generates a signal pulse designated GT. This pulse GT is used as one of the input signals of the control circuit shown in FIG. 5 and described below. The marking at the belt seam can be formed, for example, by a perforation, or by a small spot having light-reflecting properties different from those of the belt. It, however, is also practicable in accordance with the invention to employ a seamless endless belt provided at some arbitrary location with a marking.

The belt driving roller 8 of FIG. 1 is connected with a so-called pulse disc which forms part of a pulse generator, as described more particularly in U.S. Pat. No. 3,912,390. By means of this pulse generator signal pulses CL can be generated at a frequency proportional to the speed of movement of the belt 5. The signal pulses CL are used as an external input signal for the main electrical control circuit to be described.

Another input signal, designated DA, for the main control circuit is generated by a so-called selector. This selector comprises a setting mechanism by means of which the operator of the copying machine can set the number of copies to be made from one and the same original, and an electrical circuit which compares the pre-set number of copies with the number of copies already produced. A signal DA is generated in the output of the selector circuit as long as at least one copy of the original still remains to be made.

The main control circuit for a machine according to FIG. 1 is shown in FIG. 4. It consists principally of a counter 60, a shift register 70 and a combinatory circuit 80 in which the output signals from the counter 60 and from the shift register 70 are combined. The principal functions and operation of this main control circuit correspond to those of the control circuit disclosed in United States patent application Ser. No. 022,925 filed Mar. 22, 1979.

The count input of counter 60 is connected with the generator of the signal pulses CL. The reset input of the counter 60 is connected with a first output of the combinatory circuit 80. A signal pulse MP is generated in this first output each time when in the outputs of the counter 60 a first signal combination is present which corresponds to a predetermined number, e.g. 360, regardless of the signals present in the outputs of the shift register 70. The signal pulse MP marks the instant when an imaging section along the path traversed by the belt 5 is ready for formation of a copy. The shift register 70 is also connected via a clock input with the first output of the combinatory circuit 80, while the data input of the shift register 70 is connected with the output of the selector in which the signal DA is generated.

A copying cycle in which one or more copies are to be made from an original is started by depressing a start button. The copying cycle is now controlled by the signals DA and CL and the circuit components 60, 70 and 80, all as described more particularly in U.S. Pat. No. 3,912,390 and the aforesaid U.S. patent applications Ser. No. 022,925, the respective disclosures of which are incorporated herein by reference.

Signal pulses WE and FL respectively are generated in a second and a third output of the combinatory circuit 80 whenever a predetermined number of signal pulses CL, e.g. 280 pulses for the second output or 320 pulses for the third, but always in this sequence, has been counted by the counter 60 after the occurrence of a signal pulse MP. A signal pulse F can be generated likewise, simultaneously with the signal pulse FL, in a fourth output of the combinatory circuit 80. The signal pulses MP, WE, FL and F are control signals for the control circuit 100 shown in FIG. 5, which will now be described in greater detail.

The circuit 100 comprises a binary counter 101, a count input of which is connected to receive pulses FL from the third output of the combinatory circuit 80. A reset input of counter 101 is connected to receive the output pulses GT of the detector 50. The outputs of the counter 101 are connected with the address bus of a random access memory (RAM) 102. The RAM 102 can, for example, be composed of one or more random access memories of the type Fairchild 34725. A RAM of that type includes an output register between the memory locations and the outputs.

A first and a second control input of the RAM 102 are connected with the first and second outputs respectively of the combinatory circuit 80.

The output data bus of the RAM 102 is connected both with the input bus of a read-only-memory (ROM) 102 and with the input bus of an increment circuit 104. The ROM 102 can for example be composed of one or more read-only-memories of the type Motorola MCM 14524. The output bus of the increment circuit 104 is connected with the input data bus of the RAM 102. The increment circuit 104 is built up in a known manner in such a way, with a number of EXCLUSIVE OR-gates and AND-gates (not shown), that the numerical value of the binary number at its output bus is one higher than the numerical value of the binary number at its input bus. The output bus of the ROM 103 is connected with the inputs of a memory element 105, such for example as a 6-bit latch of type NSC 74C174. A control input of the memory element 105 is connected to receive the signal pulses FL from the third output of the combinatory circuit 80. The outputs of the memory element 105 are connected with a digital-analogue (D-A) coverter 106, which supplies a voltage across its output at a value governed by the numerical value of the binary number at the outputs of the memory element 105.

The output of the converter 106 is connected with a reference input of a power supply circuit 107 for the flash lamps 108. A control input of the power supply circuit 107 is connected with a potentiometer 109, the wiper of which is generally connected mechanically with a slide or a rotary button on the actuating panel of the copying machine so that a machine operator can control the illumination of the original by the flash lamps 108. An ignition input of the power supply circuit 107 is connected with the fourth output of the combinatory circuit 80. The magnitude of the supply voltage for the flash lamps 108 is made dependent in a known way, such as by means of operational amplifiers and multipliers, on the voltage at the wiper of the potentiometer 109 and the voltage across the output of the convertor 106.

Figure 6:
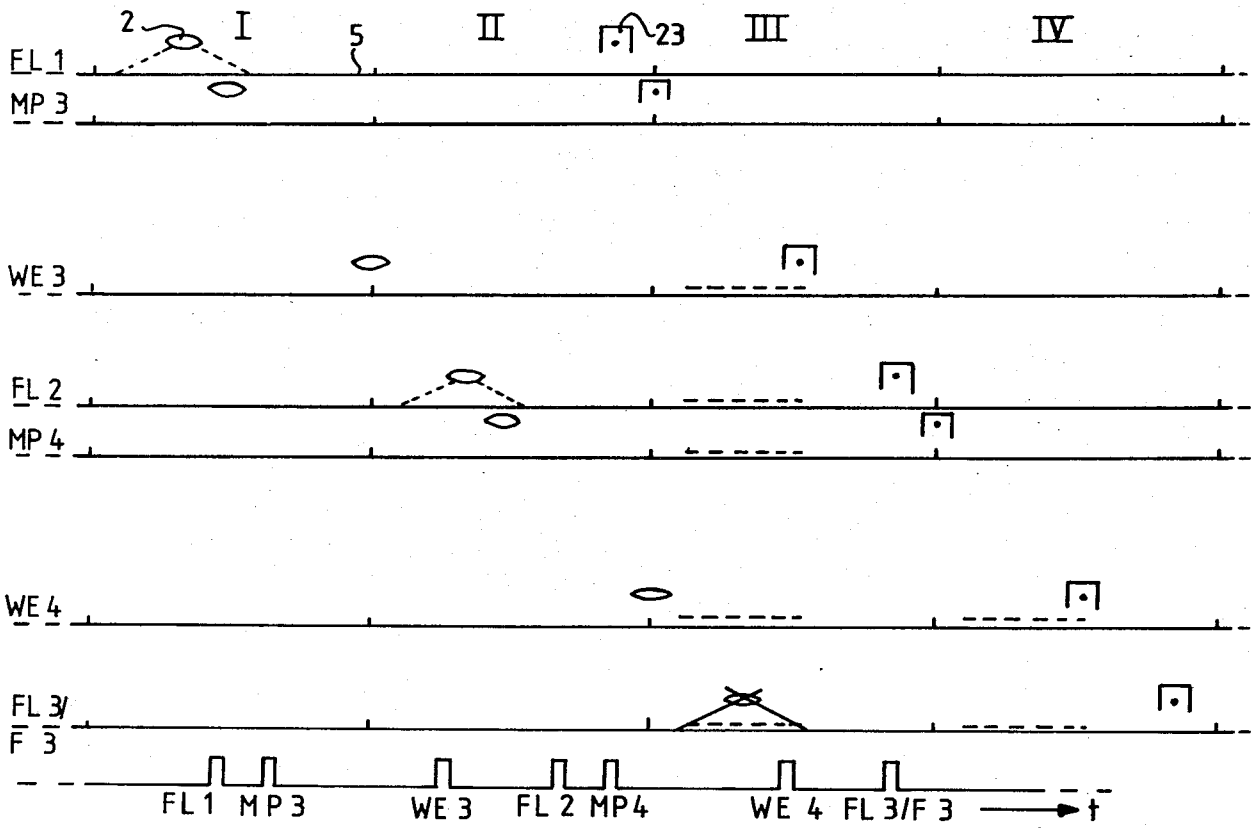
FIG. 6 shows schematically the relationship between the presence of control pulses for the control circuit of FIG. 5 and the positions of the photoconductive element relative to the exposure station.

The operation of the control circuit 100 is as follows:

As long as the copying machine is in operation and the belt 5 is being passed through the machine, the combinatory circuit 80 generates a signal pulse FL whenever an imaging section of the belt arrives at the exposure station. The path traversed by the belt 5 in the machine between the corona device 23, where a copying cycle starts, and the exposure station is of a certain length. As a result the signal pulse FL is generated, as diagrammed for example in FIG. 6, while a first imaging section (I) is present in the exposure station, so in the field of illumination from the lens 2 (FIG. 1), a second imaging section (II) has not yet completely passed the corona device 23, and a third imaging section (III) is still completely before, or upstream of, the corona device 23.

By so locating the detector 50 that the signal pulse GT is generated at the moment when a border between two imaging sections is still at a certain distance from the corona device 23, it is ensured that a binary number is then present at the output of the counter 101 which counts the signal pulses FL. This binary number indicates which imaging section after the said border, viewed in the direction of movement of the belt 5, is present before the corona device 23. Accordingly, the signal pulse FL generated while the said first imaging section I is present in the exposure station, which will be designated as signal pulse FL 1, ensures that the binary number then present at the output of the counter 101 is that which corresponds with the said third imaging section. As a result, the contents in RAM 102 of the memory location pertaining to the address designated by the said binary number are placed in the output register of RAM 102.

The contents of each memory location in RAM 102 addressable by the counter 101 consist of a number which, for each imaging section pertaining to that address, indicates the number of times a copy has already been made with the use of the pertaining imaging section.

As a result of the creation of the signal pulse FL 1, the number which indicates how many times a copy has been made with use of the third imaging section appears in the output register of RAM 102. Upon the further movement of the belt 5 the border between the second and the third imaging sections reaches the corona device 23. At that moment, by means of the combinatory circuit 80, a signal pulse MP is generated which will be designated MP 3. The signal pulse MP 3 is a control signal from RAM 102, by means of which the contents of the output register of RAM 102, in this case the number which indicates how many times a copy has been made with use of the third imaging section, are placed on the output data bus of RAM 102.

As a result the contents of the output register of RAM 102 also appear on the input buses of ROM 103 and the increment circuit 104. The increment circuit 104 increases the numerical value of the contents of the output register of RAM 102 by one, and it places the signal thus formed ready on the input data bus of RAM 102. From the contents of the output register of RAM 102, ROM 103 forms a binary number at its own output. This binary number indicates which of the levels of the step-shaped curve 91 or 92 is to be set for the voltage to the flash lamps 108. Assuming that the number of such levels amounts to sixteen, which has appeared to be fully sufficient in practice, a 4-bit binary number is sufficient to indicate each level clearly. The binary number is then ready at the inputs of the memory element 105, in order to be included in the memory element 105 on receipt of the next succeeding signal pulse FL, which in the following is designated FL 2.

After the signal pulse MP 3 has been formed with the consequences noted above, the border between the second and third imaging sections moves past the corona device 23 towards the exposure station. Assuming that a copy is to be made with the use of the third imaging section, the corona device 23 then is activated so that the third imaging section subsequently is provided with an electrostatic charge. Shortly after being passed by the border between the second and third imaging sections the corona device 23 is switched on, and it is switched off before being passed by the border between the third imaging section and a fourth imaging section (IV) adjacent thereto. The switching on and off of the corona device 23 for a certain imaging section takes place only if a copy will be made with the use of the imaging section in question, as determined for example by a signal such as the signal DA.

The disconnection of the corona device 23 results in the combinatory circuit 80 generating a signal pulse WE, which in the following is designated as WE 3.

In response to a signal pulse WE the RAM 102 enters the signal present on its input data bus in the memory location which at that moment is indicated by the counter 101. As in the operation being considered the signal pulse FL 1 is the last pulse which has been supplied to the count input of counter 101, the signal present on the input data bus of RAM 102 is entered, in response to signal pulse WE 3, at the memory location which corresponds to the third imaging section. This ensures that the numerical value of the contents of that memory location is increased by one as compared with the condition existing when the third imaging section had not yet reached the corona device 23. If the corona device 23 had not been switched on when passed by the third imaging section, the signal pulse WE 3 would not have been formed and the contents of the memory location of RAM 102 pertaining to the third imaging section would not have changed. As use is made of a RAM having an output register, the changed contents of the said memory location do not appear on the output data bus of the RAM 102.

Upon the further movement of belt 5, the second imaging section reaches the exposure station and the combinatory circuit 80 generates the signal pulse FL 2. As a result the complete procedure described above starts again, but now for the fourth imaging section, and signal pulses FL 2, MP 4 and WE 4 are generated one after the other. Likewise, in response to the signal pulse FL 2, the 4-bit binary number at the outputs of ROM 103 is taken up into the memory element 105. Inclusion in the memory element 105 signifies that the signal which is present at the inputs thereof at the moment of the signal pulse FL is transmitted to the outputs thereof and remains there until the following signal pulse FL occurs.

Thus, the binary number that is formed by ROM 103 and pertains to the third imaging section is available after signal pulse FL 2 at the inputs of the digital analogue converter 106. As a result, after the occurrence of signal pulse FL 2 the converter 106 delivers across its output a reference voltage which is determined by the number of times a copy has been made with the use of the third imaging section.

Upon the subsequent movement of the belt 5 the third imaging section arrives at the exposure station. Then the combinatory circuit 80 generates a signal pulse F, which shortly precedes the signal pulse FL 3 and in the following is designated F 3. As a result of the signal pulse F 3 the flash lamp 108 is excited so as to illuminate the original and consequently the third imaging section with an illumination intensity which, via the converter 106, the ROM 103 and the RAM 102, is dependent on the number of times a copy has been made with use of the third imaging section. As already explained above, the contents of the memory location which pertain to the third imaging section are not changed if no copy is to be made by use of the third imaging section.

The use of the control circuit as described above in an electrophotographic copying machine results in there being for each exposure of an original a certain setting of the potentiometer 109 by which a clear copy of that original is obtained, regardless of when and with the use of which imaging section that copy is made. In the above, a certain imaging section is or is not used for making a copy, depending upon whether or not the corresponding imaging section has been provided with an electrostatic charge by the corona device 23. In actual practice this has been found to be a useful criterion. Other functions, however, such as developing an image or transferring the image, can be used as well for determining whether a certain imaging section is or is not to be used for making a copy in further movement of the belt.

Figure 7:
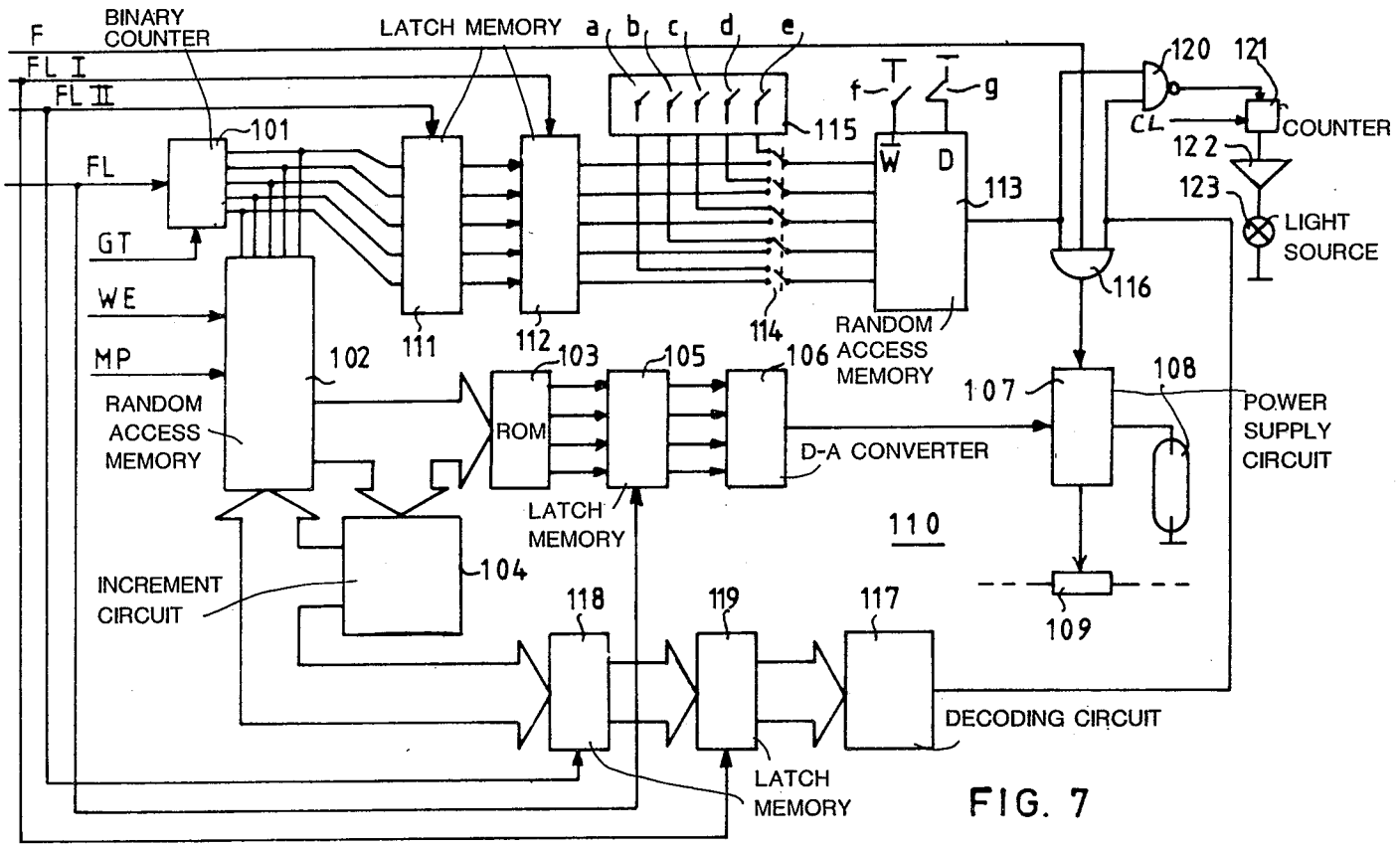
FIG. 7 is a schematic diagram of another control circuit in accordance with the invention.

FIG. 7 shows a circuit 110, the heart of which is composed of the circuit 100 described above and shown in FIG. 5. The circuit 110 comprises means to prevent the signal F from reaching the power supply circuit 107, so that no copy will be formed as a result of the signal F. The binary counter 101, the RAM 102, the ROM 103, the increment circuit 104, the memory element 105, the digital-analogue converter 106, the power supply circuit 107, the flash lamps 108 and the potentiometer 109 are the same and are connected and function in the same way as described above.

The combinatory circuit 80 to be used in connection with the circuit 110 generates two more successive control signals, FL I and FL II respectively, just before it generates the signal FL. The output of the combinatory circuit 80 that generates the signal FL II is connected to a control input of a memory element 111. The inputs of the memory element 111 are connected with the outputs of the counter 101. The outputs of the memory element 111 are connected with the inputs of another memory element 112. A control input of the memory element 112 is connected to the output of the combinatory circuit 80 that generates the signal FL I.

The outputs of the memory element 112 are connected to the address bus of a RAM 113 via a switch 114. The RAM 113 can be, for example, a 64×1 bit random access memory of the type MCM 14505. A data input D of the RAM 113 is permanently connected to ground through a switch g. A wright-enable input $\overline{W}$ of the RAM 113 is connectable to ground through a switch f. The switches f and g can be operated manually.

The RAM 113 functions as a storage element in which, at the memory locations, information can be stored as to whether or not a certain imaging section is to be used in copy formation. Each memory (or more generally storage) location is addressable through the address bus of the RAM 113. By applying an address to the address bus of the RAM 113 the information stored in the memory location identified by that address is carried by the output of the RAM 113. By choosing the counter 101 to deliver the address, as by the circuit shown in FIG. 7, it is assured that the putting out of the information stored in the memory locations of RAM 113 is synchronized with the feeding of the belt 5 past the processing stations in the copying machine.

In a first position of the switch 114 the input lines of the address bus of the RAM 113 are connected to the corresponding outputs of the memory element 112. In a second position of the switch 114 these input lines are connected to the corresponding outputs of a switching member 115. The switching member 115 comprises a number of switches a, b, c, d and e. Each of the switches a, b, c, d and e can be set manually to let the corresponding output carry an "0" signal or a "1" signal. With the switch 114 set to it's second position it is thus possible to select manually any address of the RAM 113 by setting each of the switches a, b, c, d and e in the appropriate position.

The output of the RAM 113 is connected to a first input of a three input AND-gate 116. A second input of the AND-gate 116 is connected to the fourth output of the combinatory circuit 80. The third input of the AND-gate is connected to the output of a decoding circuit 117. The data input bus of the decoding circuit 117 is connected to the output bus of the increment circuit 104 via a first memory element 118 and a second memory element 119. Control inputs of the memory elements 118 and 119 are connected to the outputs of the combinatory circuit 80 that generate the signals FL II and FL I respectively. The memory elements 111, 112, 118 and 119 can each be, for example, a 6-bit latch of the type NSC 74C174.

The decoding circuit 117 generates an "0" signal every time a binary number higher than a specified maximum number appears at it's inputs. The outputs of the RAM 113 and the decoding circuit 117 are each connected to an input of a two-input NAND-gate 120. The output of the NAND-gate 120 is connected to a START-input of a counter 121. A clock input of the counter 121 is connected with the pulse generator that generates the pulses CL. An output of the counter 121 is connected through a suitable amplifier 122 to a light source 123. The light source 123 is excited at the start of a count and is extinguished after the counter 121 has counted a number of pulses corresponding to a charged length of belt on which no latent electrostatic image has been generated because the AND-gate 116 did not pass the signal F.

The operation of the control circuit 110 is as follows:

With respect to the operation of the elements 101 through 109 reference is made to the description of the operation of the control circuit 100 shown in FIG. 5. However, where in the control circuit 100 a single signal pulse FL is provided, the three signal pulses FL I, FL II and FL are provided in this order, shortly following each other, in the circuit 110. From the description of the control circuit 100 it follows that after the signal pulse FL I occurs, this pulse having been preceded by the signal pulses FL I 1 and FL II 1, the binary number that corresponds with the third imaging section is present at the output of the binary counter 101, and thus at the input of the memory element 111. As a result the contents of the memory location in RAM 102 pertaining to the address designated by the said number are placed in the output register of the RAM 102. The next relevant control signal generated by the combinatory circuit 80 is the signal pulse MP 3. As a result of this signal the contents of the output register of the RAM 102 appear on the respective input buses of the ROM 103 and the increment circuit 104. The output of the increment circuit 104 then carries a binary number the numerical value of which is one higher than the numerical value of the contents of the output register of RAM 102. The output signal of the increment circuit 104 is now present at the input data bus of the RAM 102 and at the input of the memory element 118.

Assuming, as in the description of control circuit 100, that a copy is to be made with use of the third imaging section (III in FIG. 6) then this imaging section subsequently is charged electrostatically by the corona device 23. After charging the third imaging section the corona device 23 is disconnected with resultant generation of the signal pulse WE 3 in the combinatory circuit 80. In response to the signal pulse WE 3 the output signal of the increment circuit 104 is entered at the memory location that corresponds to the third imaging section. Upon further movement of belt 5 the signal pulses FL I 2, FL II 2 and FL 2 are generated by the combinatory circuit 80. The consequences of the signal FL I 2 do not matter at this moment. Due to the appearance of the signal FL II 2 at their respective control inputs the memory elements 111 and 118 are activated. As a result, after the disappearance of the signal FL II 2 at the outputs of the memory elements 105,111 and 118, the following signals are present: at the output of memory element 105, the binary number formed by ROM 103; at the output of memory element 111, the binary number that corresponds with the third imaging section; and at the output of memory element 118, the binary number that is present at the output of increment circuit 104 and relates to the third imaging section.

After the signal pulse FL 2 occurs the converter 106 delivers across its output a reference voltage which is determined by the number of times a copy has been made with use of the third imaging section. With subsequent movement of the belt 5 the signal pulses MP 4 and, if appropriate, WE 4 are generated one after the other and the third imaging section arrives at the exposure station. The next signal to be generated by the combinatory circuit 80 is the signal pulse FL I 3, which activates the memory elements 112 and 119. As a result the output of the memory element 112 carries the binary number that corresponds with the third imaging section. That binary number designates an address in RAM 113. As a result the contents of the memory location pertaining to that address are placed at the output of RAM 113. The content of a memory location in RAM 113 is either a "1" signal or an "0" signal, depending upon whether or not the corresponding imaging section is to be used in copy formation.

Assuming that the third imaging section is to be used in copy formation, after the signal pulse FL I 3 the output of RAM 113 carries a "1" signal, which "1" signal thus is also present at inputs of the AND-gate 116 and of the NAND-gate 120. Also as a result of the signal pulse FL I 3 the output of the memory element 119 carries a binary number the numerical value of which is one higher than the number of times the third imaging section has been used in copy formation. From that binary number the decoding circuit 117, which for example may consist of a digital analogue converter followed by a level detector such as an operational amplifier, determines whether or not the third imaging section has been used a maximum number of times in copy formation.

Referring to the right hand side of the graph in FIG. 2, it will be evident that an imaging section can effectively be used only a limited number of times in copy formation. After that the degradation of the imaging section has gone so far that the section should not be used any more in copy formation. Assuming that the third imaging section has not been used the maximum number of times in copy formation, the decoding circuit 117 generates a "1" signal at its output, which "1" signal is also present at inputs of the AND-gate 116 and the NAND-gate 120. Since both input signals to the NAND-gate 120 are "1" signals the output of the NAND-gate 120 carries an "0" signal. This prevents the counter 121 from being started and the light source 123 from being excited. The next signal generated by the combinatory circuit 80 is the signal pulse FL II 3, which causes the information relating to the fourth imaging section to be pesent at the outputs of the memory elements 111 and 118. Following the signal pulse FL II 3 the combinatory circuit 80 generates the signal pulse F 3 at the third input of the AND-gate 116. Since both of the other inputs of the AND-gate 116 then carry a "1" signal, the signal pulse F 3 is transmitted via the AND-gate 116 to the power supply circuit 107. As a result the flash lamp 108 is excited to illuminate the original, and consequently the third imaging section, with an illumination intensity which, via the the converter 106, the ROM 103 and the RAM 102, depends upon the number of times a copy has been made with use of the third imaging section.

It has been assumed in the foregoing that the third imaging section was to be used in copy formation and that it had not been so used the maximum number of times. If either one of these conditions were not fulfilled, the output signal of the RAM 113 and/or the output signal of the decoding circuit 117 would be an "0" signal. As a result the output signal of the NAND-gate 120 would change from an "0" signal to a "1" signal, whereby the counter 121 would be started and the light source 123 would be excited to discharge the third imaging section before development.

The contents of the memory locations in the RAM 113 can be changed manually when desired by appropriate setting of the switching member 115 and switches f and g. For this purpose, the switch 114 is switched to its second position and the switches a, b, c, d and e are set manually to positions which correspond to the binary number representing the address of the relevant memory location. Then the switch g is set to have the data input line at D carry a 37 1" or an "0" signal, depending upon the intended content of the memory location. Finally the switch f is closed temporarily, as a result of which the signal present at the D input of the RAM 113 is entered in the memory location indicated by the signal at the address bus. In this way an operator is able to exclude certain imaging sections from copy formation. Reasons for such exclusions can be, for example, the presence of scratches or other irreparable damage on the photoconductive side of the belt 5.

Although the circuit 110 has been described as having the input of memory element 118 connected to the output of increment circuit 104, it will be evident that the input of the memory element 118 could be connected to the output of the RAM 102 without any change in the functioning of the circuit 110.

Figure 8:
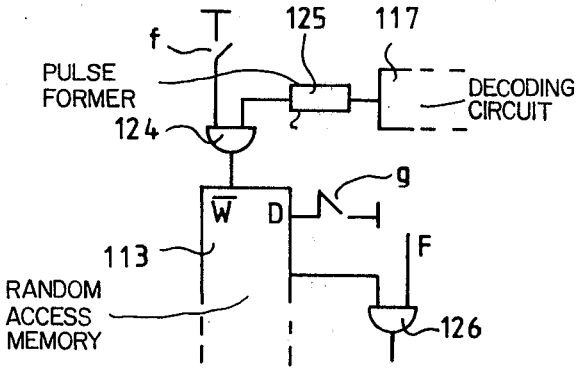
FIG. 8 shows an alternative circuit for a part of the circuit of FIG. 7.

FIG. 8 shows an alternative embodiment useful as a part of the circuit 110 (FIG. 7) for changing the content of a memory location in the RAM 113. A wright-enable input $\overline{W}$ of the RAM 113 is connected to the output of a two input AND-gate 124. A first input of the AND-gate is connected to the switch f of circuit 110. A second input of the AND-gate 124 is connected via a pulse-forming element 125 to the output of the decoding circuit 117. When a certain imaging section has been used the maximum number of times in copy formation, the address of that imaging section is available at the address bus of the RAM 113 at the time when the output of the decoding circuit 117 carries an "0" signal (it being assumed that the first input of the AND-gate 124 carries a "1" signal if the switch f is in the open position). As a result the "0" signal at the D input of the RAM 113 is written in the memory location corresponding to that certain imaging section. Following the entry of the "0" signal at said memory location, since the address on the address bus has not changed, the output of the RAM 113 will carry an "0" signal. The output of the RAM 113 is connected to a first input of a two input AND-gate 126. The second input of the AND-gate 126 is connected to the fourth output of the combinatory circuit 80. The output of the AND-gate 126 is connected to the ignition input of the power supply circuit 107.

Figure 9:
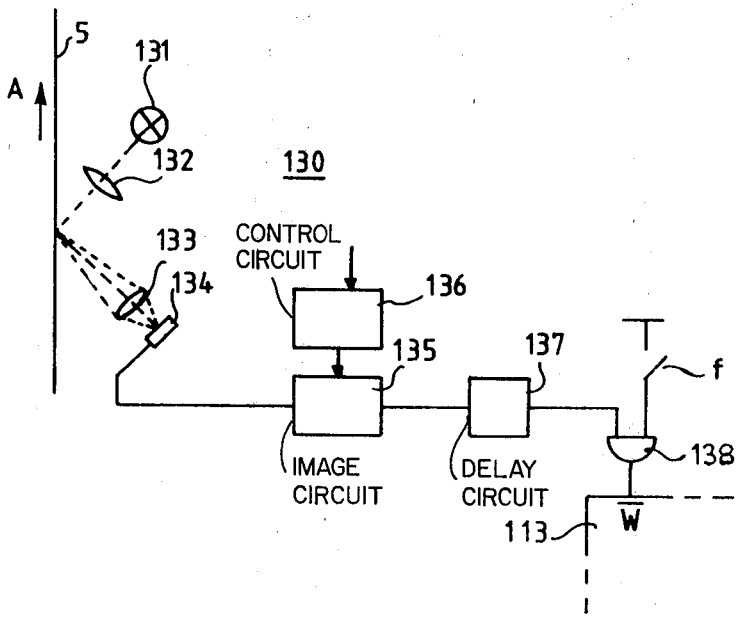
FIG. 9 shows a further alternative for a part of the circuit of FIG. 7.

FIG. 9 shows a way to automatize the changing of the contents of a memory location in the RAM 113. The belt 5 passes an optical station 130 in the direction of the arrow A. The station 130 comprises a light source 131 and an optical element 132, e.g. a cylindrical lens, to throw a line of light across the photosensitive side of the moving belt 5. The illuminated line on the belt 5 provides a test image which is imaged by a lens 133 or other imaging means onto a light-sensitive element 134 that may be, for example, a linear array of charge coupled devices. The output of the element 134 is connected to the input of an image processing circuit 135 which is controlled by a control circuit 136. A suitable image processing circuit is described in the December 1979 issue of "Philips Technisch Tijdschrift." For synchronization a control input of the control circuit 136 is connected to the control logic of the copying machine. The image processing circuit 135 generates an "0" signal as soon as it detects a disabling fault, such as one caused by a scratch, in the image of an imaging section. A delay circuit 137 is connected between the output of the circuit 135 and a first input of a two-input AND-gate 138. The delay circuit 137 assures that the "0" signal pertaining to a faulty imaging section is present at the wright-enable input $\overline{W}$ of the RAM 113 at the same time when the binary number corresponding to that particular imaging section is present at the address bus of the RAM 113.

The above descriptions of the operation of illustrative embodiments of the invention are regarded as sufficient to enable persons skilled in the art to design corrresponding circuits with the use of other starting criteria.

The diagrams of FIGS. 5, 7, 8 and 9 show primarily hardware electronic components combined to achieve the described results in a copying machine employing a belt divided into imaging sections, with one or more of the processing stations being adjusted individually to suit the condition of each particular imaging section passing by them. The set-ups of the diagrams are not intended to be restrictive, as various alternatives may be employed for achieving their functions. For example, with state of the art electronics it is possible that some of the blocks shown will not be distinguishable in a physical way as hardware components. The counter 101 can exist, for example, as one of the 1,024 memory locations of a 1 k-byte RAM forming part of a digital microcomputer. Microcomputer control circuits programmed to function in copying machines in the same way as the mainly hardware circuits described by way of example in this application are intended to be included in the claimed subject matter.

What is claimed is:

1. In an electrophotographic copying machine comprising a plurality of processing stations and a photoconductive element movable past said stations for making copies, wherein electrophotographic properties of said element change predictably as a function of the number of copies made by its use, and means for adjusting one or more of the processing stations to suit properties of said element, a control system comprising a said photoconductive element divided relative to a reference point into a plurality of imaging sections each of which is usable for copy formation, counter means comprising a plurality of counting elements, including one for each of said imaging sections, which respectively count the number of copies made by use of the corresponding imaging sections, circuit means for registering the position of said photoconductive element relative to one or more of said processing stations, and means connecting said adjusting means with said counter means and said registering circuit means and operative while said processing stations are acting on any one of said imaging sections to adjust one or more of said stations in accordance with the count by a said counting element of the number of copies made by use of the particular imaging section.

2. A copying machine according to claim 1, said control system comprising comparison means to compare the actual copy count of a said counting element with a number representing a present number of copies and means responsive to said comparison means to prevent copy formation on a particular imaging section when the actual copy count of the counting element pertaining to that imaging section is equal to or higher than said preset number.

3. A copying machine according to claim 1 or 2, said control system further comprising a storage element having a plurality of storage locations for storing information as to whether or not particular ones of said imaging sections are to be used in copy formation, means to synchronize the outputting of such stored information with movement of said photoconductive element past said processing stations and means coupled to said storage element and responsive to information stored therein when a particular one of said imaging sections is not to be used in copy formation to prevent copy formation on that imaging section.

4. A copying machine according to claim 3 and further comprising means for continually forming and sensing a test image from the surface of said photoconductive element, means for generating a control signal when through the test image a defect is detected in any of said imaging sections, and means for applying said control signal to said storage element so that information stored therein as to the particular imaging section sensed defective will cause said information responsive means to prevent copy formation by use of that imaging section.

5. In an electrographic machine comprising a plurality of processing stations and an imaging element movable past said stations for making copies, said element being divided relative to a reference point into a plurality of imaging sections each of which is usable for copy formation, and control circuit means for registering the position of said imaging element relative to one or more of the processing stations, a control circuit comprising a storage element having a plurality of storage locations for storing information as to whether or not particular ones of said imaging sections are to be used in copy formation, means to synchronize the outputting of such stored information with movement of said imaging element past said processing stations and means coupled to said storage element and responsive to information stored therein when a particular one of said imaging sections is not to be used in copy formation to prevent copy formation on that imaging section.

6. A machine according to claim 5 and further comprising means for continually forming and sensing a test image from the surface of said imaging element, means for generating a control signal when through the test image a defect is detected in any of said imaging sections, and means for applying said control signal to said storage element so that information stored therein as to the particular imaging section sensed defective will cause said information responsive means to prevent copy formation by use of that imaging section.

* * * * *